US006813922B2

(12) United States Patent
Etienne

(10) Patent No.: US 6,813,922 B2
(45) Date of Patent: Nov. 9, 2004

(54) BENDING MACHINE FOR RODS WITH RESETTABLE FOLDING SHANK

(75) Inventor: Joël Etienne, Saint Die (FR)

(73) Assignee: Numalliance, Saint Michel sur Meurthe (FR)

( * ) Notice: Subject to any disclaimer, the term of this patent is extended or adjusted under 35 U.S.C. 154(b) by 0 days.

(21) Appl. No.: 10/240,342

(22) PCT Filed: Mar. 28, 2001

(86) PCT No.: PCT/FR01/00936

§ 371 (c)(1),
(2), (4) Date: Oct. 1, 2002

(87) PCT Pub. No.: WO01/74509

PCT Pub. Date: Oct. 11, 2001

(65) Prior Publication Data

US 2003/0089153 A1 May 15, 2003

(30) Foreign Application Priority Data

Apr. 3, 2000 (FR) ..... 00 04317

(51) Int. Cl.[7] ..... B21D 11/12

(52) U.S. Cl. ..... 72/307; 72/294; 72/217; 72/388

(58) Field of Search ..... 72/307, 306, 294, 72/217, 216, 388, 387

(56) References Cited

U.S. PATENT DOCUMENTS 3,857,271 A 12/1974 Ritter et al. ..... 72/306
4,248,273 A 2/1981 Marcello ..... 72/217
5,025,651 A * 6/1991 Del Fabro et al. ..... 72/294
5,375,447 A * 12/1994 Del Fabro et al. ..... 72/307

FOREIGN PATENT DOCUMENTS

| | | | | |
|---|---|---|---|---|
| EP | 349 953 A | * | 1/1990 | 72/306 |
| EP | 0850707 | | 7/1998 | |
| FR | 2553314 | | 4/1985 | |
| FR | 2715334 | | 7/1995 | |
| WO | WO 9926739 | | 6/1999 | |

* cited by examiner

*Primary Examiner*—Daniel C. Crane
(74) *Attorney, Agent, or Firm*—Gary M. Cohen

(57) ABSTRACT

A digitally controlled machine for bending, forming, or curving raw parts, such as rods, wires or profiled sections, comprises a conventional main frame (1) and a rotating bending head capable of bending articles in different planes. The rod (4) is horizontally displaced along a transport axis (5) by a feed station, located upstream, and is brought through a bending shank (7) borne by the main frame (1). The rod is then brought through a lathe (10) of the bending head. The lathe is formed by a bending roll (8) and a folding pin (9), and is capable of rotating in a horizontal plane about an axis of rotation aligned with the axis of the bending roll (8). The bending shank (7) is movably mounted in translation in a transport axis (5) and is continuously displaced between one or more projecting bending positions wherein the shank is proximate to the roll (8) and one or more retracted positions, facing upstream, which completely clear the bending zone between the lathe and the main frame.

13 Claims, 7 Drawing Sheets

BENDING MACHINE FOR RODS WITH RESETTABLE FOLDING SHANK

BACKGROUND OF THE INVENTION

The present invention relates to an improvement to a numerically controlled machine for curving, forming, folding or bending bars or sections, and to methods for controlling such a machine.

Current machines of this type have various limitations. For example, the loops are difficult to produce, particularly when their diameter is very large and they need to be closed. The number of radii possible on one and the same part is often limited. It is rarely possible to form loops at both ends of a part. Producing folds at the final end of a long part entails slowing of the folding as a result of the high inertia of the part. The flatness of closed frames is difficult to guarantee because of the twisting of the part on the initial wire. Parts having both large radii with a large wrap angle and small radii followed by short straight lengths pose problems of variation in folding or pin/folding snout distance. Producing reverse folds (bayonets) takes time because of changes in the sides of the folding pin. Soft or coated wires are difficult to work because of constraints on contact and relative movement between the tool and the wire.

SUMMARY OF THE INVENTION

These functions, which were difficult or even impossible to achieve beforehand, are achieved by providing a bending machine with a snout which is retractable.

This is achieved with a numerically controlled machine for curving, forming, folding or bending a bar, having conventional components including a bed and a rotary bending head. The rotary bending head is able to obtain folds in various planes. A bar is moved horizontally along a line of travel by a feed station, arranged upstream, and is conveyed through a folding snout carried by the bed, and then through a turner of the bending head. The turner is formed of a bending roller and a folding pin, and is able to turn in a horizontal plane about an axis of rotation aligned with the axis of the bending roller.

In accordance with the present invention, the folding snout is mounted to move in translation along the line of travel, and is moved continuously between one or more forward bending positions in which the snout is near the roller, and one or more positions which are retracted toward the upstream end, and the bending region between the turner and the bed is left totally free.

The invention will be better understood from the detailed description which is provided below, with reference to the following illustrations.

DETAILED DESCRIPTION OF THE INVENTION

For purposes of simplification, the term "bar" has been used in the present description and in the claims to denote, more generally, an unfinished part which can be a bar, a wire or a section prior to bending. Also for purposes of simplification, achievements and movements have been described with respect to a horizontal plane, as shown in the figures. Such achievements can, of course, be reproduced in all working planes.

Figure 1:
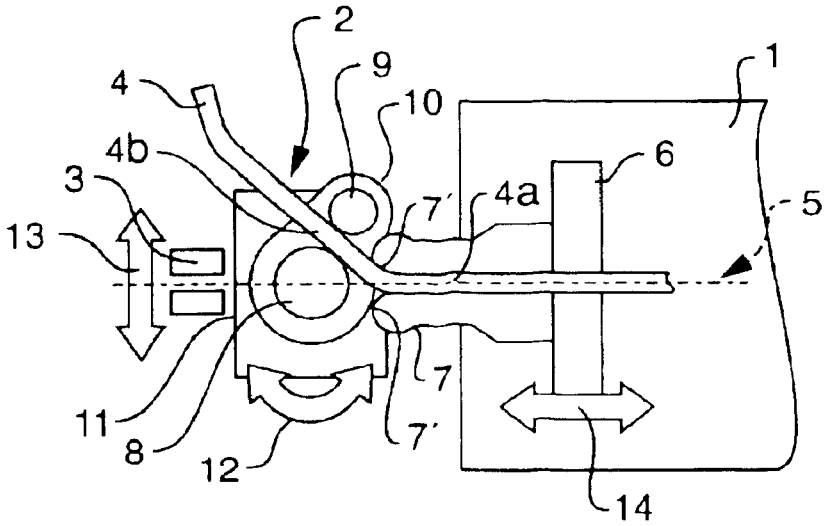
FIG. 1 is a schematic illustration of the bending machine, showing the various movements that can be accomplished on the machine.

FIG. 1 schematically depicts, from above, a numerically controlled machine which is produced in accordance with the present invention. The machine conventionally includes a bed (1) and a rotary bending head (2) so as to be able to obtain folds in various planes.

A bar (4) is moved horizontally along a line of travel (5) by a feed station (not shown) which is situated upstream. The bar (4) is conveyed through a folding snout (7) carried by the bed (1), and then through a turner (10) of the bending head (2). The turner (10) is formed of a bending roller (8) and a folding pin (9).

In a way which is per se known, the turner (10) can turn in a horizontal plane about an axis of rotation aligned with the axis of the bending roller (8). In accordance with the present invention, the turner (10) is carried by a transverse carriage (11) which is additionally able to move the turner in one direction and the other at a right angle to the direction of the line of travel (5).

Further in accordance with the present invention, a pickup gripper (3) is placed on the line of travel (5). downstream of the turner (10). As an example, the pickup gripper (3) can be placed on the outside of the turner, as shown in the figures. The pickup gripper (3) is used only, in certain operations, which are discussed below.

In accordance with the present invention, the turner (10) has two possibilities for movement. The turner can rotate in a horizontal plane, shown by the arrow (12), so as to pivot the turner and produce either a fold angle between the bar portion (4*a*) and the bar portion (4*b*) passing through the turner, by pressing against surfaces (7') of the snout (7), or a loop, by forming on the bending roller (8). The turner can also move in horizontal translation, shown by the arrow (13), at a right angle to the line of travel (5).

Furthermore, and as is a main feature of the present invention, the folding snout (7) and the cutter (6) which is associated with the folding snout (7) are mounted for translational movement along the line of travel (5), shown by the arrow (14), and are continuously moved as a single unit between one or more forward work positions in which the snout is near the roller (8) and one or more positions which are retracted toward the upstream end, totally freeing the working region between the turner and the bed. In the examples shown, the cutter (6) is placed upstream of the folding snout (7), on the line of travel (5), and moves with it. Other locations are also possible.

It is the combination of these two new movements, including translation of the turner and translation of the snout, with the previously known movements including rotation of the turner and feeding of the bar, which makes it possible to perform operations which were not previously achievable.

Figure 2A:
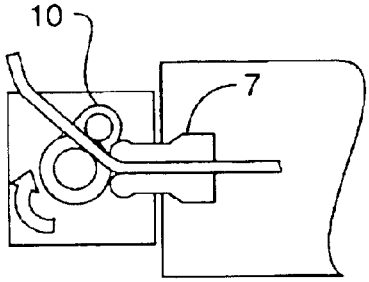
FIGS. 2A, 2B and 2C are sequential schematic illustrations of the bending machine, showing the production of a parallel-branch closed loop.
Figure 2B:
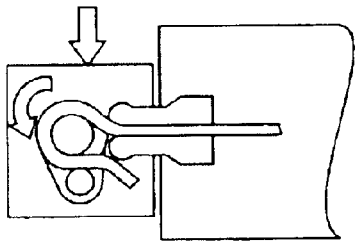
Figure 2C:
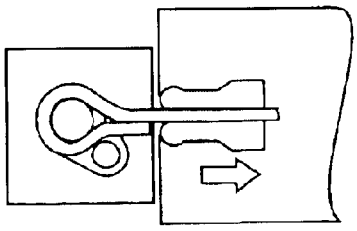

For example, a closed loop can be produced by the operations which are schematically shown in FIGS. 2A, 2B and 2C. With the snout in the forward position, the start of the loop is produced by rotating the turner (10) to the left, as is shown in FIG. 2A. Then, the loop is produced by rotating and translating the turner (10) to the right, as is shown in FIG. 2B. Finally, once the snout has been withdrawn, the loop is closed at the desired angle, for example, by returning the end of the bar to a position parallel with the line of travel (5), as is shown in FIG. 2C.

Figure 3:
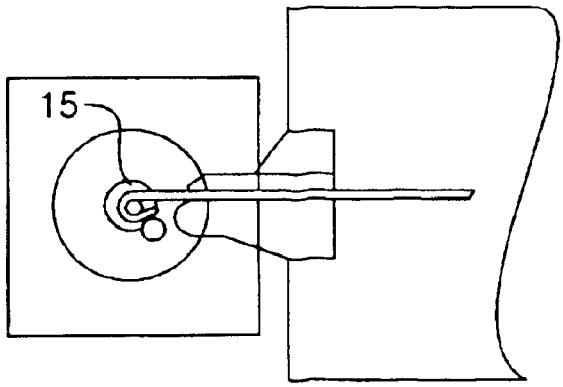
FIG. 3 is a schematic illustration of the bending machine, showing the production of loops or folds with different radii.

Loops or folds with several radii can be produced by the operations which are schematically shown in FIG. 3. By changing the tool, it is possible to produce loops or folds with several radii using a stepped retractable shaft (15) with several radii, in combination with a snout of an appropriate profile. The position of the snout with respect to the tool can be adjusted so as to guide the bar correctly and reduce the reaction against bending. In this case, "producing the loop" is to be understood as meaning "producing a closed part" or producing bends of greater than 180°.

Figure 4A:
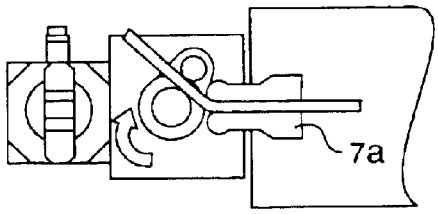
FIGS. 4A, 4B, 4C, 4D and 4E are sequential schematic illustrations of the bending machine, showing the production of loops at both ends of a portion of wire.
Figure 4B:
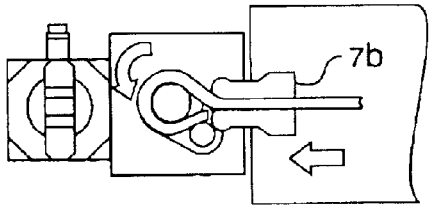
Figure 4C:
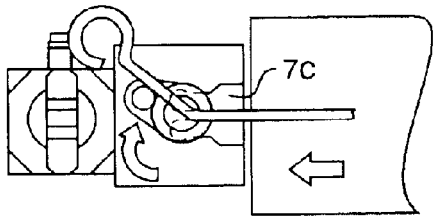
Figure 4D:
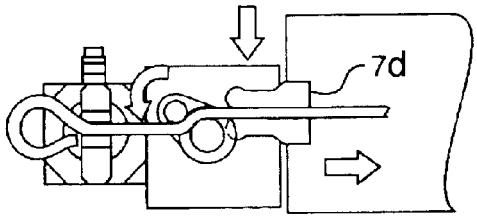
Figure 4E:
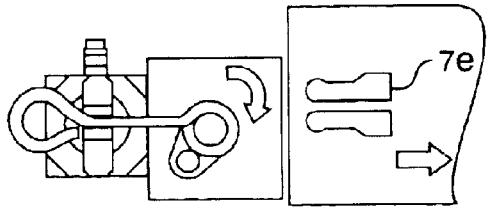

Loops can be produced at both ends of a length of bar by the operations which are schematically shown in FIGS. 4A, 4B, 4C, 4D and 4E. Referring to FIG. 4A, rotating the turner (10) to the left begins a first loop. The snout is then in a first forward position (7*a*). Referring to FIG. 4B, the snout is advanced in the downstream direction, as far as a forward position (7*b*). Rotating the turner (10) to the right closes the first loop. Referring to FIG. 4C, once the straight length of bar has been fed through, the head pivots to the left to begin the second loop. The snout is still forward and placed in a position (7*c*), while the bending roller (8) is retracted under the snout. Referring to FIG. 4D, the length of bar is picked up in the pickup gripper (3) so that the bar is cut to the desired length, and the head is moved in translation and turned to the right to bend the second loop. The snout is then retreated to the cutting position (7*d*). Referring to FIG. 4E, the snout is retreated and retracted, completely to the position (7*e*), to allow the turner (10) to continue its rotation to finish the second loop and free the end of the bar.

Figure 5:
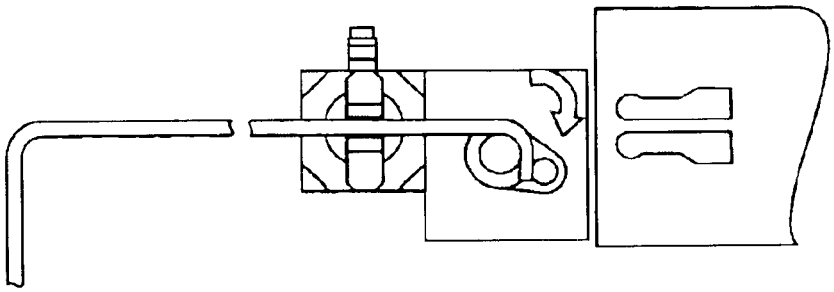
FIG. 5 is a schematic illustration of the bending machine, showing production of the last fold in a long part.

The last fold in a long part can be produced by the operations which are schematically shown in FIG. 5. The pickup gripper (3) grasps the wire (4), and the snout (7) and the cutter (6) position themselves to cut the part to the desired length. Once the part has been cut, the snout disengages and retreats, and the turner (10) finishes the last fold in the long part.

Figure 6:
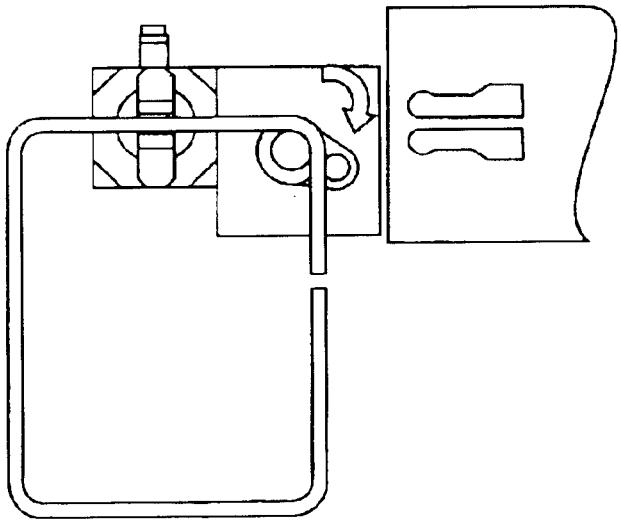
FIG. 6 is a schematic illustration of the bending machine, showing the production of flat closed parts.

Flat closed parts can be produced by the operations which are schematically shown in FIG. 6. The operations used to finish the last fold that closes a frame are the same as the operations used to produce the last fold in a long part.

Figure 7A:
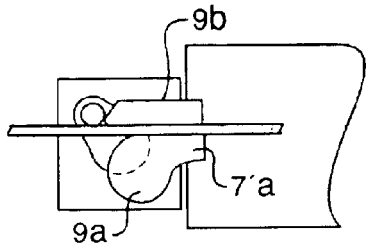
FIGS. 7A, 7B, 7C, 7D and 7E are sequential schematic illustrations of the bending machine, showing the production of a large arc with a large radius followed by a fold with a small radius.
Figure 7B:
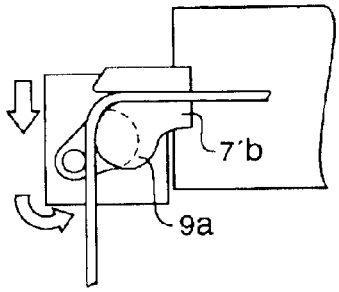
Figure 7C:
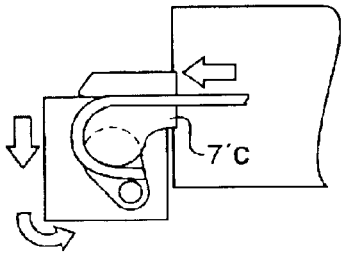
Figure 7D:
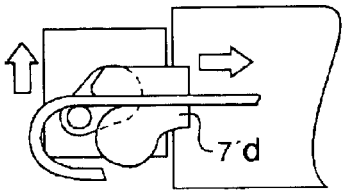
Figure 7E:
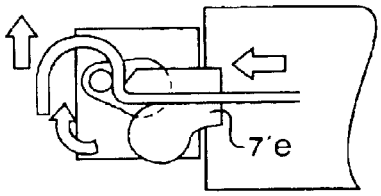

A large arc with a large radius followed by a fold with a small radius can be produced by the operations which are schematically shown in FIGS. 7A, 7B, 7C, 7D and 7E. Referring to FIG. 7A, the guide snout is replaced with an asymmetric snout (7'*a*) with a folding shape of a different radius (9*b*). Referring to FIG. 7B, the large arc of the part is begun by translation and rotation of the part to wind the part around the large radius of curvature (9*a*). The snout is then in the position (7'*b*). Referring to FIG. 7C, the snout is advanced to the position (7'*c*), and the head continues its translational and rotational movements to obtain the desired angle, for example, to bring the end of the part back, parallel to the line of travel (5), as shown in the figure. Referring to FIG. 7D, the snout is retreated to a position (7'*d*), to completely disengage the loop and place the snout in the chosen position for producing the fold, while the turner returns in translation to its starting position. Referring to FIG. 7E, the snout advances to a position (7'*e*). The turner continues its return, in translation, and produces the fold by rotating in the opposite direction to the previous one.

Figure 8A:
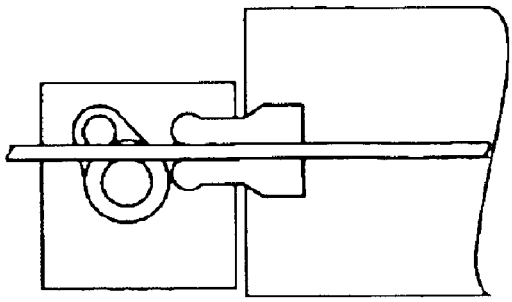
FIGS. 8A and 8B are sequential schematic illustrations of the bending machine, showing the production of two opposing folds in one hit.
Figure 8B:
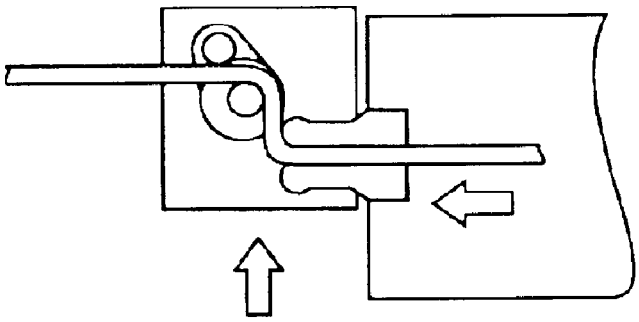
Figure 9A:
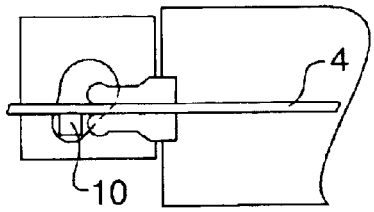
FIGS. 9A, 9B, 9C and 9D are sequential schematic illustrations of the bending machine, showing the folding without relative movement between the folding pin and the wire.
Figure 9B:
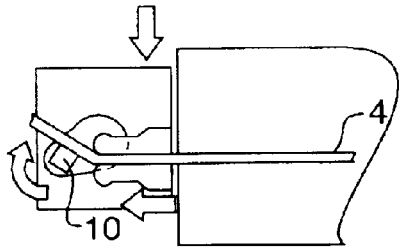
Figure 9C:
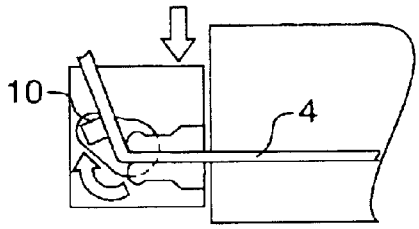
Figure 9D:
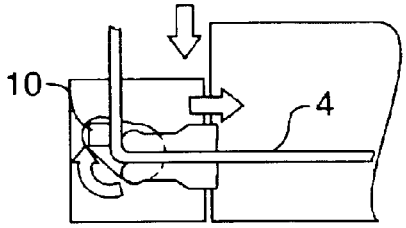

Two opposing folds can be produced in a single hit by the operations which are schematically shown in FIGS. 8A and 8B. Referring to FIGS. 8A and 8B, the combination of the forward movements of the snout (7), the feed of the bar (4), and the translation of the turner (10) makes it possible to simultaneously produce two opposing folds.

Folding can be achieved without relative movement between the folding pin (9) and the bar, as is schematically shown in FIGS. 9A through 9D. Through the combination of movements provided (bar feed, forward movement of the snout, folding, and raising of the head), the relative movement of the pin (9) with respect to the bar can be eliminated.

The foregoing list of embodiments is nonlimiting, and the software controlling the machine can be developed to meet other specifications.

The advantages of the present invention include, but are not limited to, the following. Large-diameter closed or unclosed loops can be produced. Several radii on one and the same parts can be produced, without limitation. Loops can be formed at both ends of one and the same part. A fold can be produced at the last end of a long part without slowing the folding operation. Frames can be produced without the part twisting on itself, guaranteeing flatness of the frame. The problems of variation in folding, and pin/folding snout distance, can be eliminated. Reverse folds can be produced without a loss of time. The ability to work on soft or coated wires is made possible by adjustment of the contact between the tool and wires. It is possible for the snout to be brought up close to the part during folding, for good guidance, and retracting the part at the last moment, to free the working region. It is also possible to complete a loop by retracting the snout.

What is claimed is:

1. A numerically controlled machine for curving, forming, folding and bending a bar, comprising:

a bed coupled with a rotary bending head for obtaining folds in various planes;

a folding snout carried by the bed, for receiving the bar for horizontal movement along a line of travel passing through the folding snout, and for forming bends in the bar, wherein the folding snout is mounted for translational movement along the line of travel;

a turner associated with the rotary bending head and including a bending roller and a folding pin, wherein the turner is mounted in the rotary bending head for rotation in a plane and about an axis of rotation which is aligned with an axis defined by the bending roller; and a transverse carriage receiving the turner, wherein the transverse carriage is movable along a carriage axis which forms a right angle with the line of travel, for moving the turner along the carriage axis at a right angle to the line of travel;

wherein the folding snout is continuously movable between forward bending positions in which the snout is near the bending roller and retracted positions toward an upstream end of the machine, and wherein a bending region defined between the turner and the bed is totally free.

2. The machine of claim 1 which further includes a cutter positioned upstream of the snout along the line of travel, wherein the cutter is coupled with the snout for movement together with the snout.

3. The machine of claim 1 which further includes a pickup gripper positioned on the line of travel and downstream of the turner.

4. The machine of claim 1 which further includes a stepped retractable shaft having plural radii combined with a profiled snout.

5. The machine of claim 1 wherein the folding snout includes surfaces for engaging portions of the bar passing through the folding snout, to form the bends in the bar, and wherein the surfaces of the folding snout for engaging the portions of the bar are positionable near the bending roller when the folding snout is in the forward bending positions.

6. A method for operating the machine of claim 1 to produce a closed loop, comprising the steps of:

starting the loop by rotating the turner in a first direction, with the snout in a forward position;

finishing the loop by translating the turner, and rotating the turner in a second direction opposite to the first direction; and withdrawing the snout and closing the loop at a desired angle.

7. A method for operating the machine of claim 1 to produce loops and folds with plural radii, comprising the steps of:

providing the turner with a stepped retractable shaft having plural radii; and operating the stepped retractable shaft in combination with a profiled snout.

8. A method for operating the machine of claim 1 to produce loops at both ends of a length of bar, comprising the steps of:

positioning the snout in a first forward position, and rotating the turner in a first direction to begin a first loop;

advancing the snout in a downstream direction to a second forward position, and rotating the turner in a second direction opposite to the first direction, closing the first loop;

feeding a straight length of the bar through the machine, advancing the snout in the downstream direction to a third forward position while the bending roller is retracted under the snout, and pivoting the head in the first direction to begin a second loop;

picking up the straight length of the bar in a pickup gripper, retreating the snout to a first bending position, moving the turner in translation and in the second direction, bending the second loop, and then retreating the snout to a cutting position; and retreating the snout to a completely retreated and retracted position, freeing the turner to continue rotating, and finishing the second loop.

9. A method for operating the machine of claim 1 to produce a last fold in a long part, comprising the steps of:

grasping the part with a pickup gripper;

positioning the snout and a cutter associated with the snout to cut the part to a desired length; and disengaging and retreating the snout, and finishing the last fold in the part using the turner.

10. A method for operating the machine of claim 1 to produce a flat closed part, comprising the steps of:

grasping the part with a pickup gripper;

positioning the snout and a cutter associated with the snout to cut the part to a desired length; and disengaging and retreating the snout, and finishing a last fold in the part, using the turner, to close the part flat.

11. A method for operating the machine of claim 1 to produce an arc with a first radius followed by a fold with a second radius smaller than the first radius, comprising the steps of:

replacing the folding snout with an asymmetric snout having a folding shape with a first radius different from a radius of the folding snout;

retracting the snout and forming the arc by translating and rotating the part in a first direction, winding the part around the first radius to form a loop;

advancing the snout while translating and rotating the head in the first direction, continuing the loop and bringing an end of the part parallel to the line of travel;

retreating the snout to completely disengage the loop, and placing the snout in a position for producing a fold, while translating the head in a second direction opposite to the first direction; and advancing the snout to a final position, and continuing translation of the head in the second direction, producing a fold about a second radius of the asymmetric snout by rotating the head in a second direction opposite to the first direction.

12. A method for operating the machine of claim 1 to produce two opposing folds in a single hit, comprising the steps of:

combining a forward movement of the snout and a translation of the turner, simultaneously producing the two opposing folds.

13. A method for operating the machine of claim 1, comprising the step of:

folding the part without relative movement between the folding pin and the part.

* * * * *